United States Patent [19]

Gamblin

[11] Patent Number: 5,014,367

[45] Date of Patent: May 14, 1991

[54] COMMODE SEAT LIFTING APPARATUS

[76] Inventor: Tom D. Gamblin, 2704 S. Houston, Amarillo, Tex. 79103

[21] Appl. No.: 486,284

[22] Filed: Feb. 28, 1990

[51] Int. Cl.[5] ..... A47K 13/10

[52] U.S. Cl. ..... 4/251

[58] Field of Search ..... 4/251

[56] References Cited

U.S. PATENT DOCUMENTS

| | | | |
|---|---|---|---|
| 2,842,779 | 7/1958 | Zulkoski | 4/251 |
| 2,849,728 | 9/1958 | Gyllenberg | 4/251 |
| 4,103,371 | 8/1978 | Wilson | 4/251 |

FOREIGN PATENT DOCUMENTS

| | | | |
|---|---|---|---|
| 8908437 | 9/1989 | World Int. Prop. O. | 4/251 |

*Primary Examiner*—Charles E. Phillips

*Attorney, Agent, or Firm*—Leon Gilden

[57] ABSTRACT

Apparatus including a hydraulic cylinder mounting an L-shaped piston lever therewithin wherein the L-shaped lever is mounted to a rearward most portion of the under surface of a commode seat. A pneumatic chamber directs pressurized air through an associated conduit into the cylinder to direct the associated piston to project the commode seat into an elevated position relative to an associated commode. Modified aspects of the invention include an elongate pneumatic chamber coextensive with and positioned orthogonally relative to the associated pneumatic conduit with the chamber further including a plurality of pneumatic balloons captured therewithin whereupon depression of the pneumatic chamber anchors the chamber to an underlying surface to maintain the pneumatic chamber position relative to the commode.

5 Claims, 4 Drawing Sheets

PRIOR ART

COMMODE SEAT LIFTING APPARATUS

BACKGROUND OF THE INVENTION

1. Field Of The Invention

The field of the invention relates to commode seat apparatus, and more particularly pertains to a new and improved commode seat lifting apparatus wherein the same provides selective lifting of a commode seat relative to a commode.

2. Description Of The Prior Art

Commode seat lifting apparatus has been utilized in the prior art. In various forums, the need for individuals to lift a commode is a physical difficulty but a necessity in the interest of hygiene. Further, it is at times objectionable as well as difficult for individuals to grasp a commode seat to effect a lifting operation. In this regard, commode lifting seat mechanisms have been developed in the prior art. Prior art mechanisms, however, have heretofore failed to provide the convenience and effectiveness as set forth by the instant invention. Examples of the prior art include U.S. Pat. No. 3,345,560 to WATERS provides a commode lifting arrangement wherein a mechanical lever lifts a commode seat wherein a dampening cylinder dampens retraction of the seat to its original position.

U.S. Pat. No. 3,504,385 to FIELDS provides a further example of a mechanical commode lifting apparatus utilizing a lever arrangement to direct a commode seat into an upper orientation relative to an associated commode.

U.S. Pat. No. 3,528,075 to LAON is a further example of a mechanically directed commode seat lifting arrangement as opposed to the instant invention which permits a conduit directing pneumatic pressure therethrough for convenient and remote positioning of an associated pneumatic chamber to effect a lifting procedure.

U.S. Pat. No. 3,417,411 to GREENWOOD provides a further multi-link mechanical arrangement to effect lifting of a commode seat with the associated protrudences acquired of such mechanical linkages.

U.S. Pat. No. 4,534,073 to SMITH illustrates yet a further mechanically configured lifting apparatus for use in lifting of a commode seat utilizing a resilient spring biased return mechanism.

As such, it may be appreciated that there continues to be a need for a new and improved commode seat lifting apparatus wherein the same addresses both the problems of ease of use, as well as effectiveness in the remote positioning of a pneumatic treadle chamber spaced from an associated pneumatic lifting cylinder and in this respect, the present invention substantially fulfills this need.

SUMMARY OF THE INVENTION

In view of the foregoing disadvantages inherent in the known types of commode lifting apparatus now present in the prior art, the present invention provides a new and improved commode lifting apparatus wherein the same conveniently and in a spatial relationship positions a commode lifting pneumatic chamber spaced from a commode lifting pneumatic cylinder. As such, the general purpose of the present invention, which will be described subsequently in greater detail, is to provide a new and improved commode seat lifting apparatus which has all the advantages of the prior art commode seat lifting apparatus and none of the disadvantages.

To attain this, the commode seat lifting apparatus of the instant invention includes apparatus including a hydraulic cylinder mounting an L-shaped lever therewithin wherein the L-shaped lever is mounted to a rearward most portion of the under surface of a commode seat. A pneumatic chamber directs pressurized air through an associated conduit into the cylinder to direct the associated piston to project the commode seat into an elevated position relative to an associated commode. Modified aspects of the invention include an elongate pneumatic chamber coextensive with and positioned orthogonally relative to the associated pneumatic conduit with the chamber further including a plurality of pneumatic balloons captured therewithin whereupon depression of the pneumatic chamber anchors the chamber to an underlying surface to maintain the pneumatic chamber position relative to the commode.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved commode seat lifting apparatus which has all the advantages of the prior art commode seat lifting apparatuses and none of the disadvantages.

It is another object of the present invention to provide a new and improved commode seat lifting apparatus which may be easily and efficiently manufactured and marketed.

It is a further object of the present invention to provide a new and improved commode seat lifting apparatus which is of a durable and reliable construction.

An even further object of the present invention is to provide a new and improved commode seat lifting apparatus which is susceptible of a low cost of manufacture with regard to both materials and labor, and which accordingly is then susceptible of low prices of sale to the consuming public, thereby making such commode seat lifting apparatuses economically available to the buying public.

Still yet another object of the present invention is to provide a new and improved commode seat lifting apparatus which provides in the apparatuses and methods of the prior art some of the advantages thereof, while simultaneously overcoming some of the disadvantages normally associated therewith.

Still another object of the present invention is to provide a new and improved commode seat lifting apparatus which may be compactly stored when not being utilized.

Yet another object of the present invention is to provide a new and improved commode seat lifting apparatus wherein the same utilizes a pneumatic chamber positioned forwardly of a commode to permit directing of pressurized air to a laterally oriented commode lifting cylinder for the convenient and effective lifting of a commode seat thereby.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
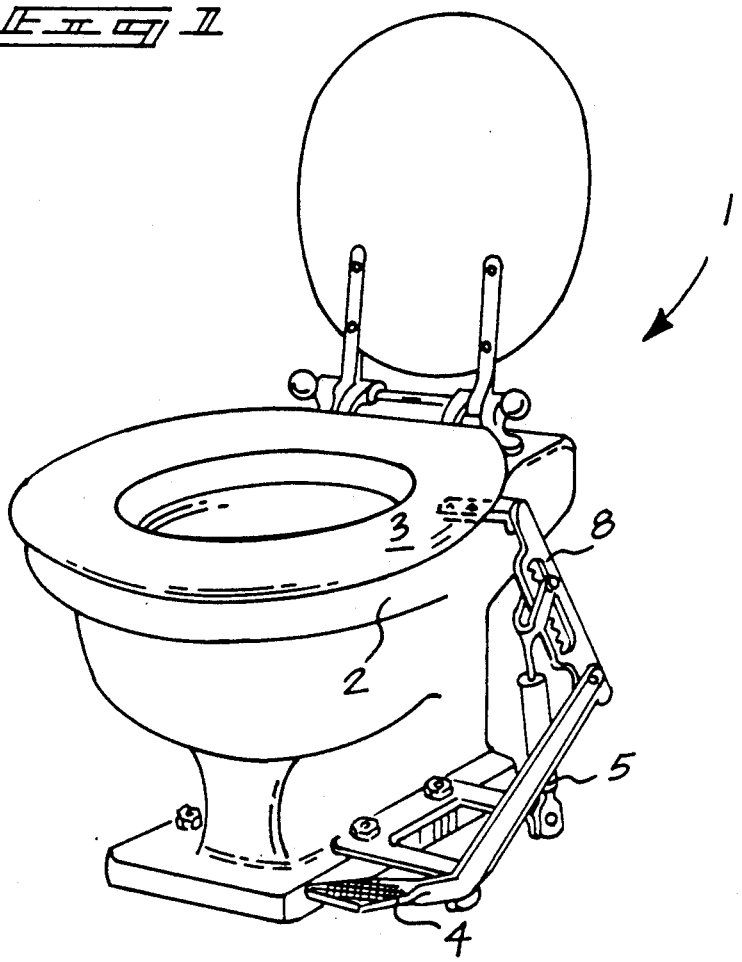
FIG. 1 is an isometric illustration of a prior art commode seat lifting apparatus.
Figure 2:
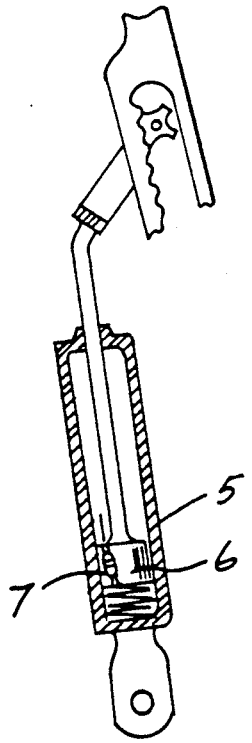
PRIOR ART FIG 2
FIG. 2 is an orthographic view partially in crosssection of the dampening cylinder utilized by the prior art apparatus as illustrated in FIG. 1.
Figure 3:
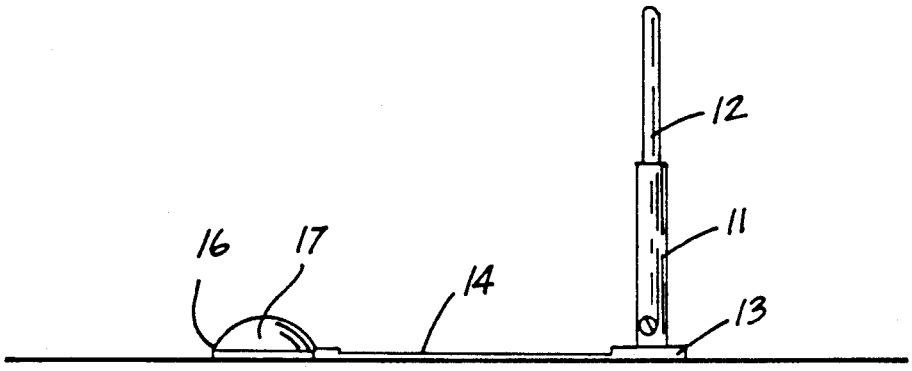
FIG. 3 is an orthographic side view taken in elevation of the commode lifting apparatus of the instant invention.

With reference now to the drawings, and in particular to FIGS. 1 to 9 thereof, a new and improved commode seat lifting apparatus embodying the principles and concepts of the present invention and generally designated by the reference numerals 10, 10*a* and 10*b* will be described.

FIG. 1 illustrates a prior art commode seat lifting apparatus 1 wherein a commode 2 includes an overlying seat 3 pivotally mounted overlying the commode wherein a treadle 4 is operative through a mechanical linkage 8 to lift the commode seat 3 wherein a dampening cylinder 5 includes an internal piston 6 formed with a relief valve 7 therewithin to permit a predetermined rate of decent of the commode seat 3 in its return to an overlying position relative to the commode 2.

Figure 4:
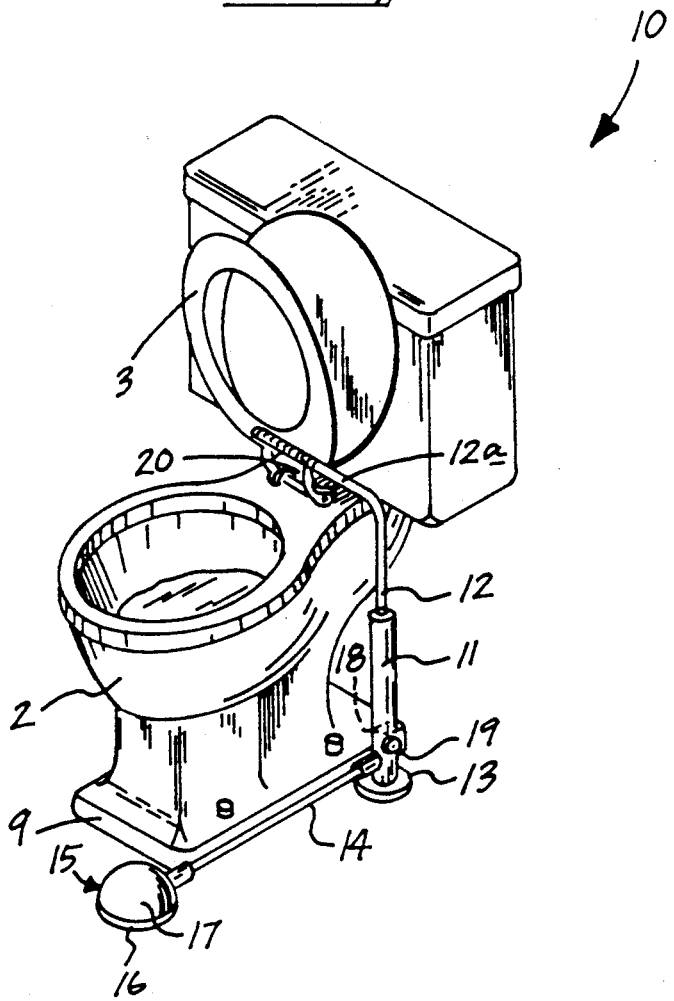
FIG. 4 is an isometric illustration of the commode seat lifting apparatus of the instant invention.

More specifically, the commode seat lifting apparatus 10 of the instant invention essentially comprises the commode 2 including a bowl with an upper opening including a commode seat 3 positioned in a pivotal surrounding relationship relative to the opening of the bowl wherein the commode includes a commode base support 9 vertically mounting the commode and associated bowl in alignment over a support surface. A pneumatic cylinder 11 is positioned adjacent to a side of the commode 2 and includes an L-shaped piston rod 12 directed outwardly thereof wherein the piston rod includes a horizontal extent 12*a* that is rotatably receivable within a sleeve 20 wherein the sleeve 20 is mounted to the underside of the commode seat 3 adjacent its rear pivotal structure as illustrated in FIG. 4. The cylinder 11 is mounted to a cylinder support plate 13 to fixedly mount the cylinder relative to the associated support surface mounting the commode itself wherein a pneumatic conduit 14 is directed from the cylinder 11 to a pneumatic pressurizing chamber 15 and includes a rigid support base 16 with a flexible dome 17 to direct pneumatic pressure through the conduit 14 into the chamber of the cylinder 11. A piston 18 is reciprocatable within the cylinder 11 with the piston rod 12 fixedly and orthogonally mounted to an upper end thereof wherein the pneumatic piston 18 includes a pressure relief valve therewithin of a type as illustrated in U.S. Pat. No. 3,345,650 incorporated herein by reference and as illustrated as the pressure relief valve 7 in FIG. 2 of the instant application. A further pressure relief valve 19 is mounted to the cylinder 11 directed exteriorly thereof to permit adjustment of the degree of pressure relief to be directed exteriorly of the cylinder 11. Upon depressing of the pressurizing chamber 15, the L-shaped piston rod 12 is directed upwardly effecting the upper movement of the associated commode seat 3 to at least an 85 degree angle whereupon rotation of the sleeve 20 relative to the horizontal extent 12*a* of the piston rod and associated inertia directs the seat rearwardly into a forced upright position. Manual contraction of this seat 3 permits its descent in a monitored manner by use of the aforenoted pressure relief valve 7 contained within the piston 18 as well as the external pressure relief valve 19 directed through the hydraulic cylinder 11.

Figure 5:
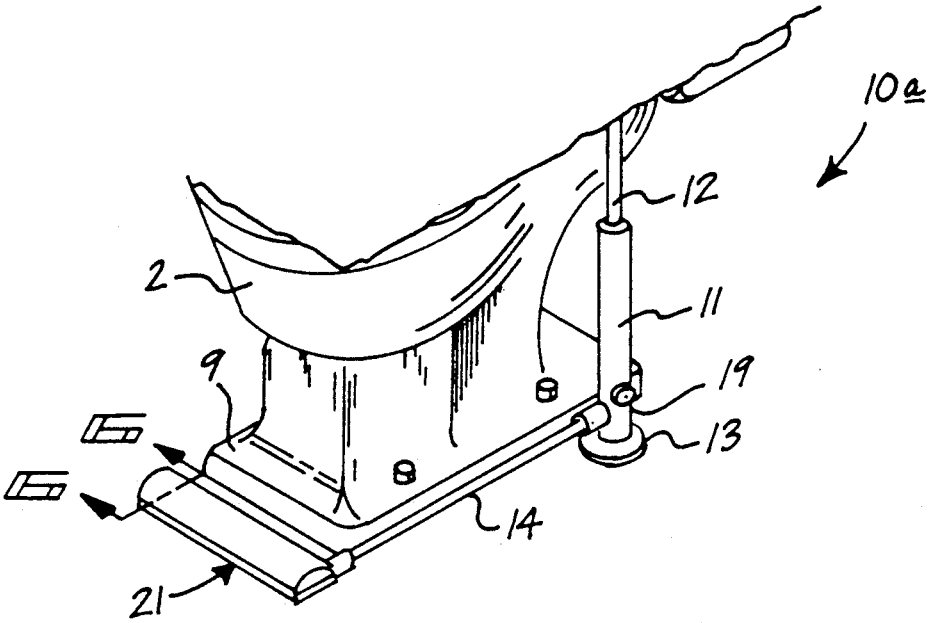
FIG. 5 is an isometric illustration of a modified commode seat lifting apparatus utilized by the instant invention.
Figure 6:
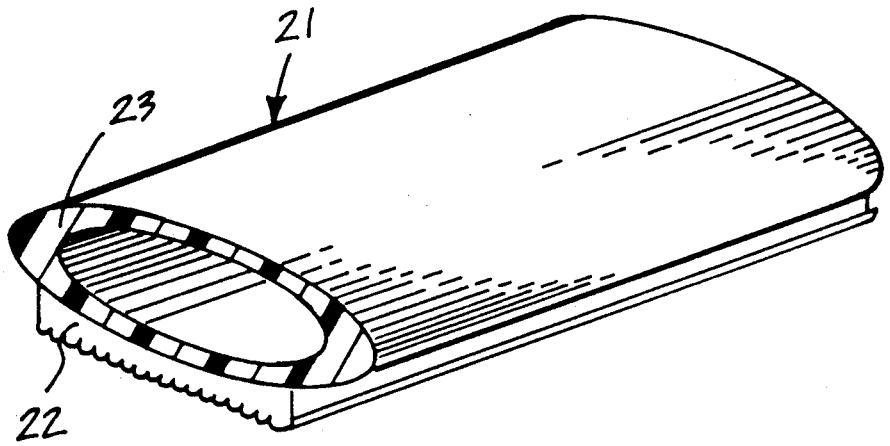
FIG. 6 is an orthographic view taken along the lines 6—6 of FIG. 5 in the direction indicated by the arrows.

Reference to FIG. 5 illustrates a modified commode seat lifting apparatus 10*a* wherein a modified elongate pneumatic chamber 21 is oriented orthogonally relative to the conduit 14 and extends completely and parallel relative to the forward end of the commode support base 9. The modified chamber 21 includes a base 22 including an elongate longitudinally aligned semi-rigid rib bottom surface 22 wherein the ribs are aligned parallel to one another and to the large longitudinal extent of the base 22. A flexible pneumatic chamber 23 formed of memory retentent material is formed coextensively overlying the base 22 to effect directing of pneumatic pressure into the conduit 14. In this manner, an individual may utilize both feet in the directing of pressure into the conduit 14 and enhances effectiveness in a lifting of the associated commode seat 3.

Figure 7:
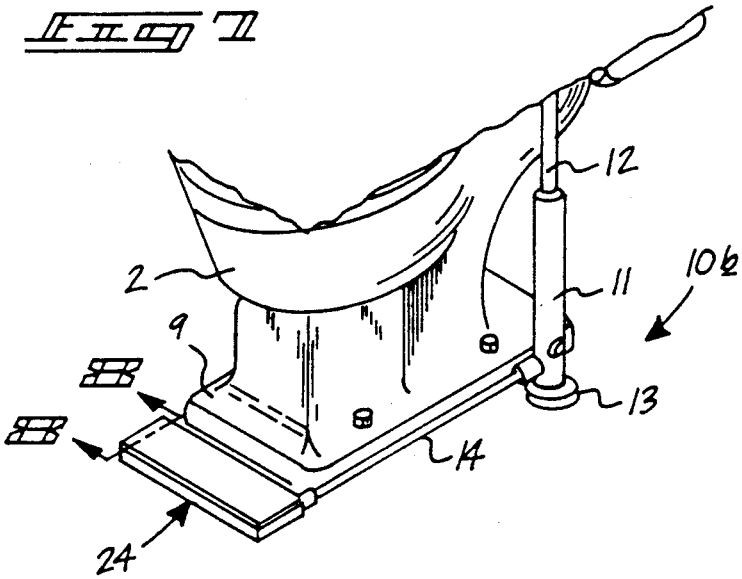
FIG. 7 is an isometric illustration of a further commode seat lifting apparatus utilized by the instant invention.
Figure 8B:
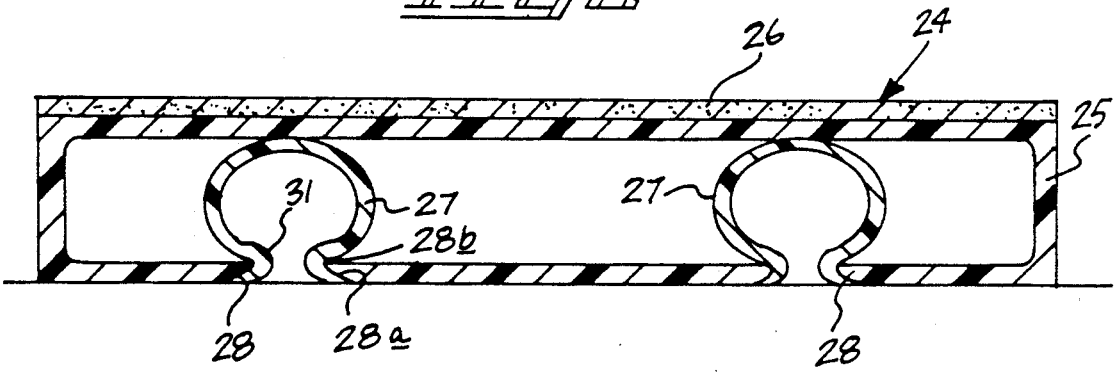
FIG. 8 is an orthographic view taken along the lines 8—8 of FIG. 7 in the direction indicated by the arrows.
Figure 9:
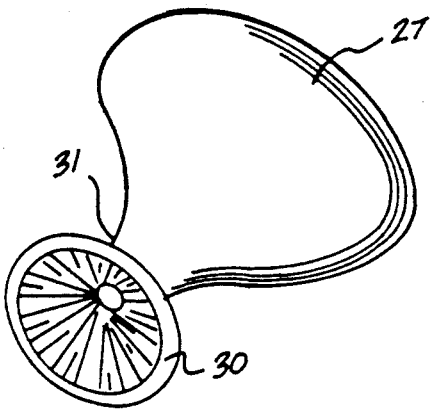
FIG. 9 is an isometric illustration of one of the plurality of sealed air bladders utilized by the instant invention.

FIG. 7 illustrates a further modified elongate pneumatic chamber 24 completely formed of memory retentent material wherein the chamber 24 includes an elongate housing 25 of a generally parallelepiped configuration including a cushioned frictional top surface 26 of a relatively soft resilient material to enhance engagement of an individual stepping with one or both feet upon the top surface 26. The housing 25 further includes a floor with a plurality of tapered openings 28 directed therethrough wherein each opening includes a forward diameter 28*a* adjacent an external surface of the floor with a rear diameter 28*b* interiorally of the floor of the housing 25. These tapered openings fixedly mount a like plurality of sealed air bladders 27 therewithin. Each of the sealed air bladders includes a restricted neck portion 31 and an enlarged mouth 30 wherein the enlarged mouth 30 is defined by a circumferential configuration substantially equal to that as defined by the forward diameter 28*a* of each of the openings 28 with the restricted neck 31 captured within the rear narrowed diameter 28*b* of a lesser diameter and circumference of the forward diameter 28*a*. Upon depressing of the housing 25 and directing of pressurized air into the conduit 14, the sealed air bladders 27 effect a sealing relationship with the underlying surface to insure positioning of the floor of the housing 25 as well as the entire pneumatic chamber 24 relative to the commode 9 in use.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A commode seat lifting apparatus in combination with a commode, the commode including a commode bowl defining an opening with a commode seat pivotally mounted overlying the bowl including a pivot structure positioned adjacent the bowl and mounted to a rear end portion of the seat, the commode further including a pedestal base mounting the commode to a support surface, the apparatus comprising, a pneumatic cylinder, the pneumatic cylinder including a support plate integrally mounted to a lowermost end of the pneumatic cylinder, the support plate mounted to the support surface positioned adjacent a side portion of the pedestal base, and a generally L-shaped piston rod reciprocatably mounted relative to the pneumatic cylinder and extending exteriorly of the pneumatic cylinder and upwardly thereof, the L-shaped piston rod including a horizontal extent rotatably receivable within a sleeve, the sleeve mounted to a bottom surface of the commode seat adjacent the pivot structure, and a pneumatic conduit including a forward end in pneumatic communication with the pneumatic cylinder, and a rear terminal end of the pneumatic conduit in pneumatic communication with a pneumatic chamber whereupon depressing of the pneumatic chamber directs the L-shaped piston rod exteriorly of the pneumatic cylinder to effect a lifting of the commode seat, and wherein the piston rod includes a piston reciprocatably mounted within the pneumatic cylinder, the piston including a pressure relief valve mounted therewithin to effect a metered descent of the commode seat when directed to a lowered position relative to the commode bowl, and wherein the pneumatic chamber includes an elongate longitudinally aligned housing, the housing arranged parallel to a forward end of the pedestal base, and the housing further orthogonally oriented relative to the pneumatic conduit, and wherein the housing is defined by a generally parallelepiped cross-sectional configuration and includes a floor underlying and parallel to a top wall, the top wall including a cushioned top surface laminated thereon, the cushioned top surface formed of a resilient frictionally engaging material to enhance engagement of an individual's foot with the top layer.

2. Apparatus as set forth in claim 1 wherein the housing is defined by a memory retentent semi-rigid material.

3. Apparatus as set forth in claim 2 wherein the housing includes a plurality of apertures directed therethrough, each of the apertures receiving a sealed air bladder in sealing relationship relative to each of the openings wherein the sealed air bladders extend upwardly into the housing above the floor.

4. Apparatus as set forth in claim 3 wherein each of the tapered openings includes an enlarged forward diameter and a smaller rear diameter to define the tapered openings wherein the rear diameter is positioned interiorly of the floor adjacent an interior cavity of the housing and wherein each of the sealed air bladders is contained within the cavity.

5. Apparatus as set forth in claim 4 wherein each bladder includes an enlarged flexible chamber and a restricted neck, the restricted neck captured within the openings of the floor of the housing, and the restricted neck directed into an enlarged mouth, the enlarged mouth of each bladder aligned with an exterior surface of the floor to engage and pneumatically lock the support surface to the floor of the housing when the housing is in a compressed configuration and subsequently released to direct pressurized air into the pneumatic conduit and sequentially effect a suction within each of the bladders to secure the bladders and associated housing to the underlying support.

* * * * *